United States Patent [19]

Lirones

[11] 4,062,399

[45] Dec. 13, 1977

[54] APPARATUS FOR PRODUCING DIRECTIONALLY SOLIDIFIED CASTINGS

[75] Inventor: Nick G. Lirones, North Muskegon, Mich.

[73] Assignee: Howmet Turbine Components Corporation, Greenwich, Conn.

[21] Appl. No.: 643,167

[22] Filed: Dec. 22, 1975

[51] Int. Cl.[2] ..... B22C 9/02; B22D 27/04

[52] U.S. Cl. ..... 164/338 M; 164/347; 164/348; 164/353; 164/361

[58] Field of Search ..... 164/60, 338, 352, 353, 164/361, 274; 249/174, 204, 206

[56] References Cited

U.S. PATENT DOCUMENTS

| | | | |
|---|---|---|---|
| 944,370 | 12/1909 | Monnot | 164/274 X |
| 1,385,595 | 7/1921 | Van Ranst | 164/274 X |
| 1,915,729 | 6/1933 | Gathmann | 249/204 X |
| 2,176,990 | 10/1939 | Crampton | 164/274 |
| 2,206,888 | 7/1940 | Greenidge | 164/274 X |
| 2,779,072 | 1/1957 | Goss | 164/274 |
| 2,970,075 | 1/1961 | Grenoble | 164/60 X |
| 3,519,063 | 7/1970 | Piearcey | 164/353 |
| 3,612,150 | 10/1971 | Rossi | 164/274 X |
| 3,754,592 | 8/1973 | Mullen | 164/60 |
| 3,810,504 | 5/1974 | Piwonka | 164/60 |
| 3,931,847 | 1/1976 | Terkelsen | 164/60 X |

FOREIGN PATENT DOCUMENTS

| | | | |
|---|---|---|---|
| 754,573 | 8/1956 | United Kingdom | 249/206 |

*Primary Examiner*—Robert D. Baldwin
*Attorney, Agent, or Firm*—McDougall, Hersh & Scott

[57] ABSTRACT

An apparatus for producing directionally solidified castings wherein a mold having an open bottom is supported on a chill plate with metal poured into the mold initially solidifying adjacent the chill plate and thereafter progressively solidifying away from the chill plate. The chill plate is provided with a plug member, and the metal being cast initially solidifies around this plug member whereby the metal is securely held in intimate contact with the plug member and adjacent chill plate surfaces so that the withdrawal of heat from the casting through the chill plate is greatly facilitated.

15 Claims, 10 Drawing Figures

FIG. 1
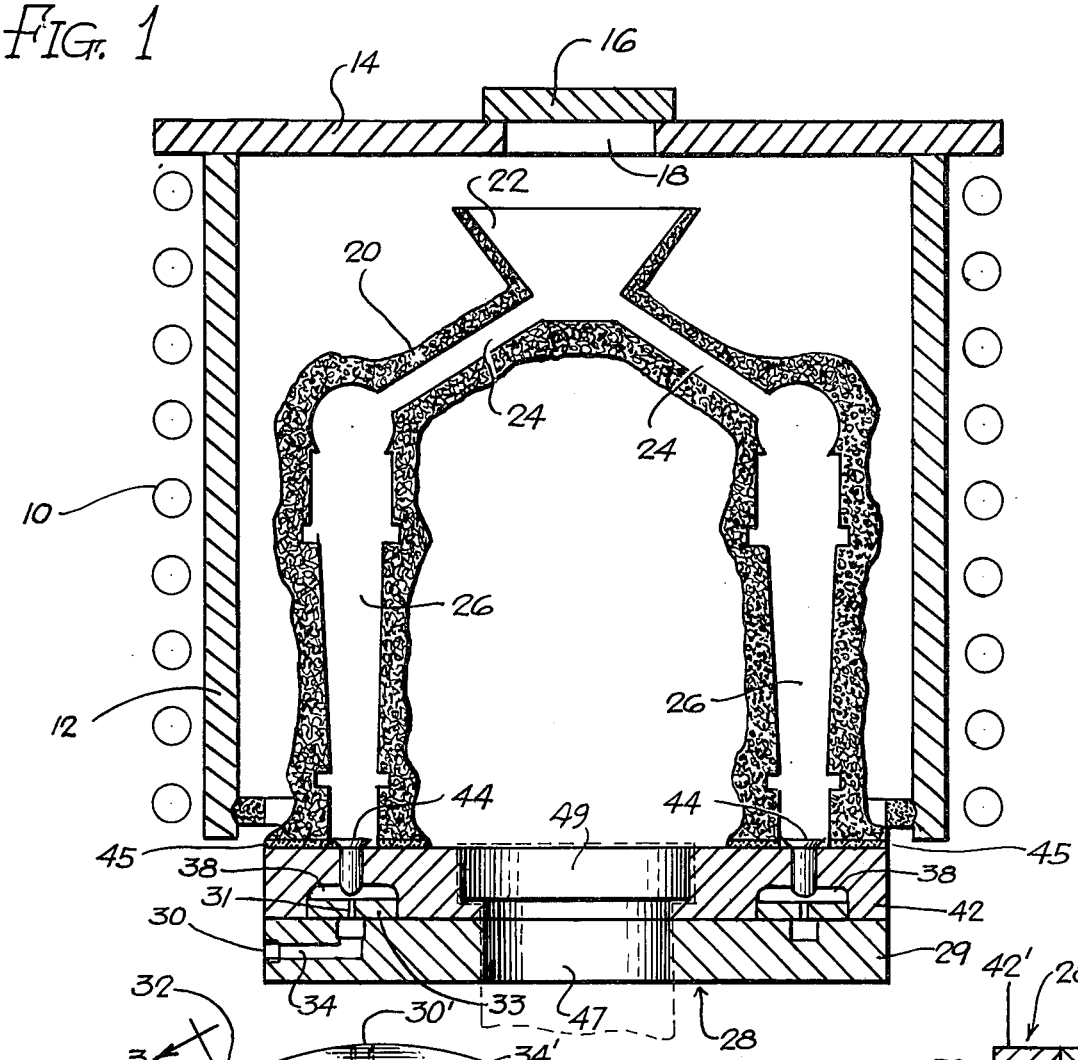
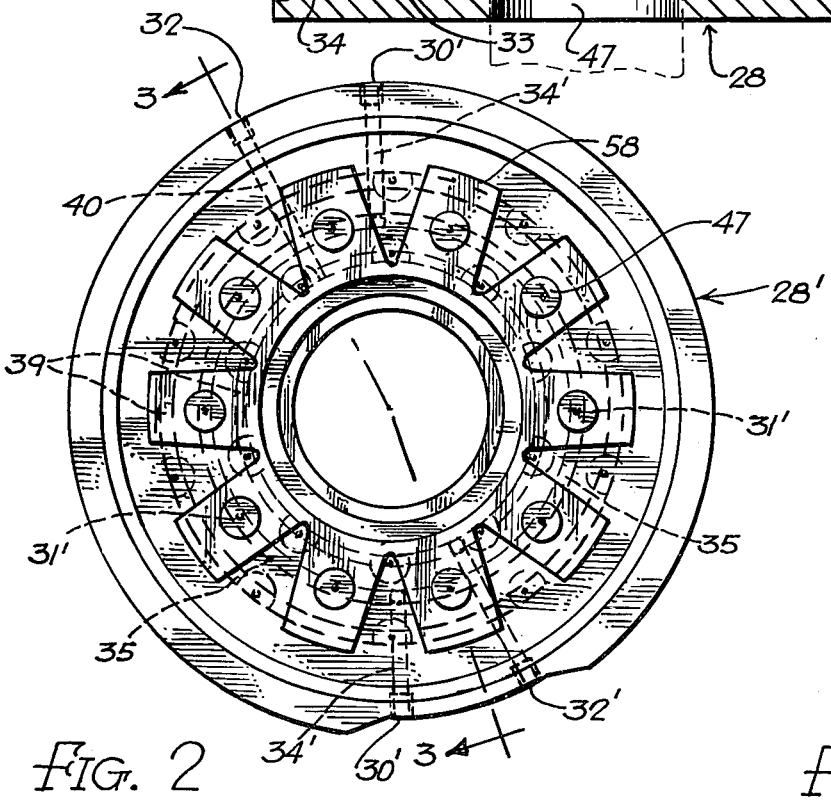
FIG. 2
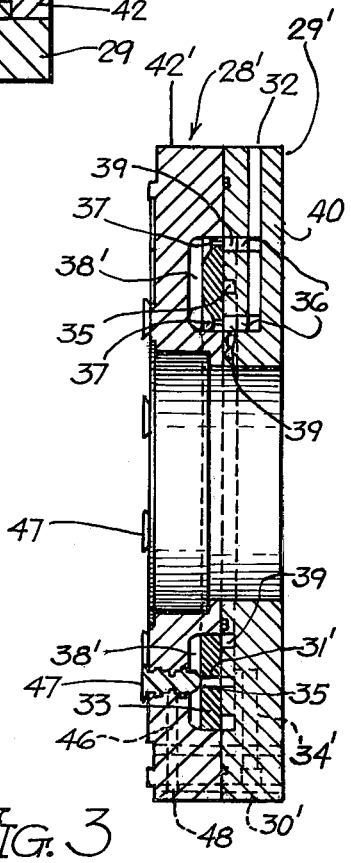
FIG. 3

APPARATUS FOR PRODUCING DIRECTIONALLY SOLIDIFIED CASTINGS

This invention generally relates to the production of precision castings. In particular, the invention is concerned with an apparatus for producing directionally solidified castings whereby columnar grain structures are achieved in the castings.

It has previously been recognized that directional solidification of certain castings for producing columnar grain structures results in significantly improved performance for such castings. A typical example involves the utilization of such castings in gas turbine engines. By producing turbine blades and vanes with the columnar grain structures as opposed to equiaxed grain structures, superior performance, particularly at elevated temperatures is achieved.

The development of the columnar grain structures is generally accomplished by positioning a ceramic mold having an open bottom on a chill plate formed of copper or other highly heat conductive material. This assembly is positioned within a furnace with selectively energizable induction heating coils and a susceptor surrounding the mold. The mold is preheated to an elevated temperature, and molten metal is then cast into the mold whereby the metal comes into direct contact with the chill plate. Solidification is thus initiated at the chill plate and then proceeds progressively away from the chill plate. Selective de-energization of the induction coils may be utilized to produce a unidirectional temperature gradient throughout the mold during solidification.

The most effective operation of a system of the type described involves withdrawal of heat from the molten metal through the chill plate. In the event that any substantial portion of the heat is withdrawn in a direction transverse to the mold-chill plate axis, there is a tendency for transverse grain growth.

In practice, the withdrawal of heat through the chill plate is impeded by the formation of a gap between the chill plate and the initially solidified material. This gap tends to be formed when the initially solidified metal undergoes shrinkage when passing from the liquid to the solid state, and the shrinkage causes at least portions of the initially solidified material to pull away from the chill plate surface. The gap formed constitutes an insulating layer whereby the efficiency of heat withdrawal through the chill plate can be significantly reduced.

This invention provides improved means for accomplishing directional solidification and the production of columnar grain structures. The object of the invention is, in particular, the provision of means which contact the initially solidified metal in the area of the chill plate and which hold the initially solidified metal in close or intimate contact with the chill plate whereby the efficiency of heat withdrawal through the chill plate is significantly improved.

A more specific feature of the instant invention involves the utilization of one or more plug members in association with a chill plate with the plug members providing means for achieving intimate communication between the chill plate and casting. In addition to providing cast products of superior quality, the preferred forms of the invention involve the utilization of plug members and chill plate designs which do not significantly affect the efficiency of the over-all casting operation from the standpoint of production speed and cost.

These and other objects of this invention will appear hereinafter and for purposes of illustration, but not of limitation, specific embodiments of the invention are shown in the accompanying drawings in which:

FIG. 1 is a vertical sectional view of a furnace, mold, and chill plate combination characterized by the features of this invention;

FIG. 2 is a plan view of the chill plate construction of FIG. 1;

FIG. 3 is a cross-sectional view of the chill plate construction taken about the line 3—3 of FIG. 2.

Figure 4:
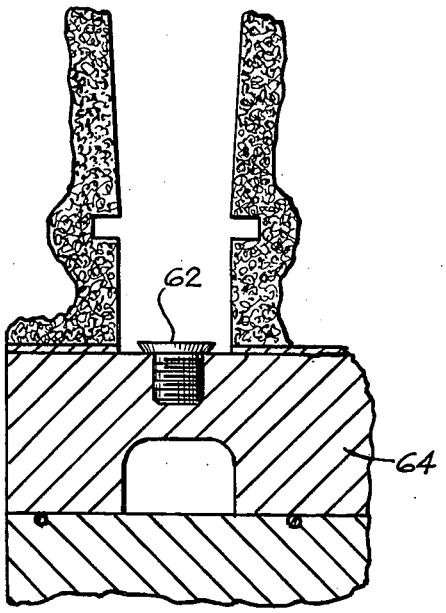
FIGS. 4–10 comprise fragmentary sectional views illustrating alternative forms of plug members utilized in the construction.

The system of this invention involves an apparatus which is of the general type employed for achieving directional solidification of castings. As indicated, this involves the use of a chill plate, and cooling means such as channels for the circulation of cooling water are normally included in the chill plate. The mold employed is typically a ceramic shell mold which includes an entry opening for the introduction of molten metal, and an open bottom which is placed on the chill plate surface. The mold is surrounded by a susceptor and heating coil assembly for preheating of the mold and for selective heating during solidification.

The invention more specifically involves the provision of one or more plug members located in association with the chill plate for exposure to the molten metal which is initially introduced into the mold. The plug members are designed so that the metal will solidify around the plug members and be held securely and in intimate contact therewith. The chill plate is designed so that the plug members are influenced by the cooling means of the chill plate so that the plug members function along with the chill plate for purposes of withdrawing heat. The plug membersare preferably formed of copper or other well-known materials having relatively high heat conductivity whereby the heat withdrawal function of the plug members can be most efficiently achieved. Materials used for forming the plug members are, generally speaking, the same materials which are known for use in the production of chill plates.

FIGS. 1–3 illustrate typical systems characterized by the features of the invention. A furnace construction is schematically illustrated in FIG. 1, and this includes induction coils 10 in surrounding relationship relative to susceptor 12. A top wall 14 extends over the chamber defined by the susceptor, and removable plate 16 provides access to the chamber through opening 18.

A ceramic shell mold 20 is located within the chamber, and the pouring spout 22 is provided for receiving molten metal poured into the chamber through opening 18. Runners 24 direct the molten metal into the mold cavities 26. In this illustration, the mold cavities are designed for the production of turbine blades, and the axes of the blades extend vertically whereby columnar grains extending parallel with these axes can be developed. It will be appreciated that other components which are improved by reason of the presence of directionally oriented grains could be readily formed with the system of this invention.

A chill plate construction 28 is employed in association with the mold and furnace construction described. In the embodiment illustrated in FIG. 1, the chill plate comprises a lower section 29 which defines side wall openings 30 for the circulation of cooling liquids such as water. The openings 30 extend to passages 34 which in turn communicate with the annular channel 38 through the openings 31 in nozzle ring 33 which extends around the plate. By continuously introducing low temperature liquid such as water, heat is readily carried away from the chill plate. As illustrated, the chill plate also comprises an upper section 42 which defines the channel 38 and which is assembled with the lower section 29, this combination facilitating formation of the internal cooling passages.

A plurality of plug members 44 are associated with the chill plate. As illustrated, these plug members include an end portion which extends within the channel 38 whereby the plug members are sprayed with the cooling liquid passing through openings 31. The plug members are preferably formed of copper or some other heat conductive material so that heat will be transferred through the plug members for withdrawal by the cooling liquid.

Insulation 45, such as strips of asbestos, may be interposed between the mold and the chill plate. This reduces the tendency for heat withdrawal from the mold into the chill plate and increases the tendency for the casting to lose heat directly to the chill plate, that is, in the desired direction.

The chill plate defines a large central opening 47 which is provided for receiving a supporting rod, 49 the rod being in turn associated with a cylinder or the like for the purpose of raising and lowering the assembly of the chill plate and mold. As explained, for example in Tingquist, et al. U.S. Pat. No. 3,841,384, this arrangement permits gradual withdrawal of the mold from the interior of the susceptor for cooling purposes. The withdrawal mechanism should be formed of some poorly conductive material or insulated from the chill plate so that heat losses from the molds will be minimal in this area.

When the casting has been completely solidified within the mold structure, gradual cooling thereof may well be desired, and in addition, time is consumed during separation of the mold and casting from the chill plate. As indicated, the plug members 44 are removable with the casting, and this also requires some time. Accordingly, and in order to permit the most efficient use of the heating mechanisms, the invention contemplates the substitution of a new chill plate and associated mold whereby an additional casting operation can be underway during the time necessary for separating the casting and mold from the previously used chill plate. By providing two or more chill plates, the heating mechanisms can be repeatedly used without encountering undue delays.

FIGS. 2 and 3 illustrate a more detailed version of a chill plate construction. The chill plate 28' comprises sections 29' and 42' with the latter holding nozzle ring 33' having openings 31'. First openings 30' are provided for the introduction of cooling liquid and for circulation through passages 34' and 35, and through openings 31' into channel 38'. The nozzle openings 31 spray liquid directly onto the bottoms of plug members 47 associated with the chill plate. The ring 33' defines additional openings 37 for passage of the liquid out of channel 38' for movement through annular passages 39 and then through passages 40 to outlet openings 32. The passages 40 communicate the channel 38' with the openings 32.

The plug members 47 associated with the chill plate of FIGS. 2 and 3 (and also shown in FIG. 6) are secured in the section 42 of the chill plate by means of elongated pins 46. These pins define threaded ends 48 for removably securing the pins in the chill plate section 42'. Each plug member defines an annular groove 50, and the reduced diameter pin ends 52 are received within this groove.

The plug members 47 define a flared upper end 54 whereby molten metal poured into the mold cavity 26 will freeze around the upper end of the plug member and will become tightly secured thereto. Each plug member is removably associated with the chill plate section 42' by forcing the plug members into openings provided for that purpose. Rubber O-rings 56 serve to prevent any leakage of cooling liquid beyond the channel 38'. After castings have been formed within the mold cavities, the pins 46 securing the plug members are backed off, and the plug members can thus be separated from the chill plate along with the castings. Replacement plug members are then provided whereby a new set of castings can be formed utilizing the chill plate.

The rings 33 or 33' may be employed for assisting in the separation of the plug members from the chill plate. Specifically, by providing means for driving a ring against the plug members, the ring will force the plug members outwardly. The action can be accomplished after the chill plate and molds have been separated from the furnace and after separation of the chill plate sections 29 and 42.

Figure 6:
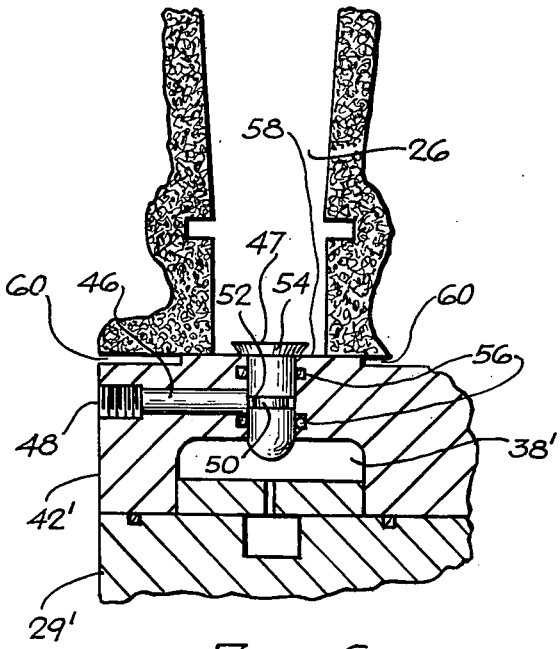

The upper surface of the chill plate of FIGS. 2 and 3 is machined to provide "peninsulas" 58 for engaging the interior bottom surface portions of the mold assembly supported on the chill plate. As shown in FIG. 6 at 60, this results in a gap between substantial mold surface portions and the chill plate, this gap serving as an insulating means. As is the case when insulation is inserted between the mold and chill plate, the gaps formed inhibit the withdrawal of heat through the mold. The heat is instead withdrawn from the castings through the plug members and through the chill plate surfaces engaged by the castings.

As illustrated, the plug members 44 and 47 extend within the respective channels 38 and 38'. The circulating liquid will thus directly engage the plug members as well as the chill plate surfaces whereby heat withdrawal through the plug members becomes a significant aspect of the casting operation.

FIGS. 4, 5 and 7–10 illustrate some alternative forms of the invention, and it will be appreciated that these embodiments could be used alone or in multiples during a casting operation. The plug member 62 illustrated in FIG. 4 is threaded into the chill plate section 62 whereby very intimate contact is achieved between the plug member and the chill plate. It will be appreciated that the cast material will effectively become welded to the plug members during a casting operation. Accordingly, separation of a plug member from the chill plate, as by unscrewing the plug member, and the substitution of a new plug member after a casting operation is accomplished without difficulty. The plug member is associated with the casting in an area of the casting which is normally cut away so that there will be no remnants of the plug member in the finished product.

Figure 5:
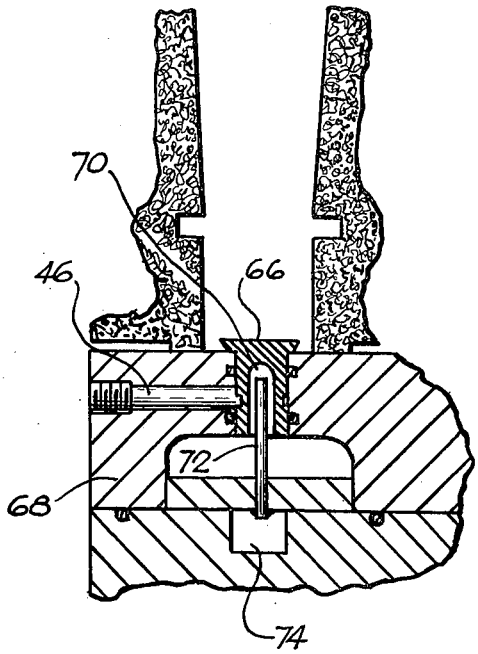

FIG. 5 illustrates a plug member 66 which is secured to chill plate section 68 by means of a pin 46 of the type shown in FIG. 6. In this instance, however, the plug member defines an interior cavity 70 and a pipe 72 extends from a coolant circulating passage 74. Coolant is forced through the pipe section 72 for dispersal within the cavities 70 whereby contact between the coolant and the cavity surface will result in rapid carrying away of heat collected in the plug member 66. The pipe 72 thus serves in the manner of a spray head which provides highly efficient heat transfer.

Figure 7:
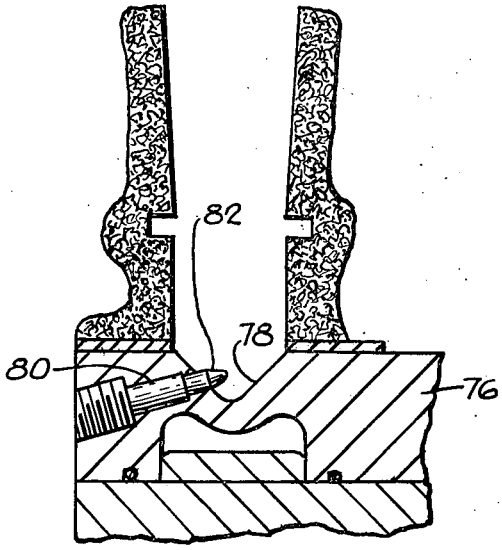

In the arrangement illustrated in FIG. 7, the chill plate section 76 defines a cavity 78 in the area of the chill plate communicating with the mold cavity. A pin 80 is threaded through an opening defined by the chill plate section 76, and the end 82 of this pin extends within the recess 78. Accordingly, molten metal will solidify around this pin end. Upon completion of a casting, the pin can be forcibly screwed outwardly for separation of the pin from the solidified casting.

Figure 8:
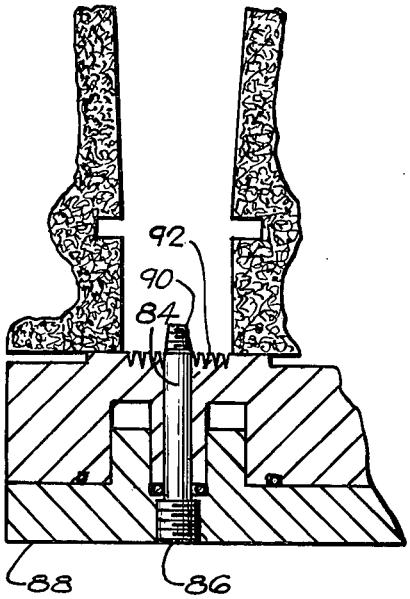

In the embodiment of FIG. 8, a vertically disposed plug member 84 is provided, and the lower end 86 of this plug member is threadably received by the lower section 88 of the chill plate. The upper end 90 of this plug member is also threaded whereby a good gripping relationship is achieved between the initially formed casting and the plug member. It will also be noted that the surface 92 of the chill plate which is exposed to the molten metal is uneven to increase the surface-to-surface contact between the initially solidified casting and the chill plate. A knurling or grooving operation may be employed for achieving this feature of the invention.

Figure 9:
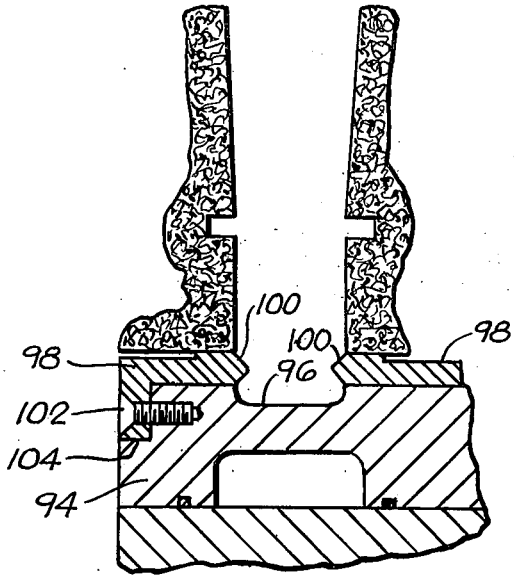

FIG. 9 illustrates a still further embodiment of the invention wherein the chill plate section 94 is provided with a recess 96. The plug members 98 in this instance define ends 100 which extend into the recess 96 on at least two sides of the casting. A threaded fastener 102 is associated with the downwardly depending portion 104 of the plug members for removably holding the plug members in place during a casting operation.

Figure 10:
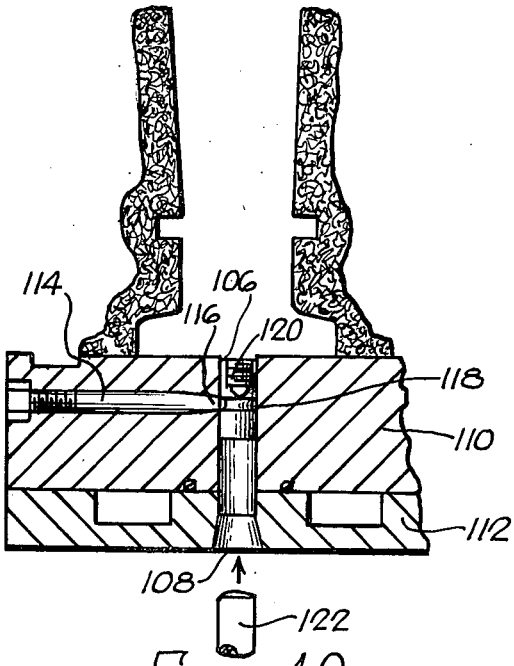

FIG. 10 illustrates a further embodiment wherein a plug member 106 is located within a vertically disposed passage 108. This passage extends through both the upper section 110 and the lower section 112 of the chill plate. A pin 114 defines a pointed end 116 which is received within a groove 118 defined by the plug member. The pin is threadably received within the section 110 of the chill plate to permit separation of the plug member from the chill plate. The plug member itself defines an internally threaded recess 120 which improves the gripping relationship between the initially formed cast portions and the plug member.

The arrangement of FIG. 10 serves to facilitate separation of the casting from the chill plate. In particular, an ejector rod 122 is adapted to be moved into the passage 108 for forcing the casting and associated plug member away from the chill plate. This is, of course, accomplished after the pin 114 has been backed away from the plug member.

The various embodiments of the invention are all disclosed as means for significantly improving casting efficiency. The plug members, being associated with the chill plate, will be exposed to the molten metal which is initially introduced into the mold. As this molten metal solidifies, the plug members will serve to hold the initially cast material in position and will serve to inhibit separation of the cast surfaces from the chill plate surfaces. Even in the event of some such separation, the plug member designs are such that there will always be intimate contact between plug member surfaces and the cast material.

The plug members are exposed directly or indirectly to the coolant utilized in the chill plate so that these plug members serve as a highly efficient means for withdrawing heat. By thus insuring the withdrawal of heat through the plug members and chill plate areas immediately exposed to the casting, the desired directional solidification is accomplished. The elimination of a complete gap between the casting and chill plate surfaces greatly reduces any tendency for heat withdrawal through the mold walls, and thus reduces any tendency for transverse grain growth.

It will be understood that various changes and modifications may be made in the above described systems which provide the characteristics of the invention without departing from the spirit thereof particularly as defined in the following claims.

I claim:

1. In an apparatus for the production of directionally solidified castings including a ceramic mold having an open bottom is supported on a chill plate, and means for pouring molten metal into the mold, the chill plate defining a surface for direct contact with the molten metal whereby the metal initially solidifies adjacent the chill plate with the casting thereafter solidifying progressively away from the chill plate, the portion of the metal contacting the chill plate and initially solidifying tending to shrink and to draw away from said chill plate surface thereby inhibiting heat transfer between the solidified metal and the chill plate, the improvement comprising a heat conductive plug member having an undercut surface area incorporated in said chill plate for communication with said open bottom of said mold, said casting thereby solidifying to said surface area of the plug member whereby the casting is securely held in intimate contact with the plug member and is inhibited against drawing away from said chill plate surface upon shrinkage of the metal, heat transfer between the solidified metal and the chill plate being thereby enhanced and heat thereby being withdrawn through the plug member and the chill plate as the casting solidifies, coolant passages defined by said chill plate for the circulation of a coolant, means for delivering coolant to said passages, a bore defined by said chill plate, said plug member being received in said bore, said bore extending from said chill plate surface to said coolant passages, and said plug member extending into said passages for direct contact of the plug member with the coolant.

2. An apparatus in accordance with claim 1 including heating means located in surrounding relationship relative to the mold, and means for progressively removing the chill plate and mold from the vicinity of the heating means.

3. An apparatus in accordance with claim 2 wherein at least one additional chill plate is adapted to be associated with the heating means for supporting a separate mold while the first chill plate and associated mold and casting are cooling independently of the heating means.

4. An apparatus in accordance with claim 1 wherein said chill plate defines an area sufficient for supporting a plurality of molds, a plug member being provided for each of said molds.

5. An apparatus in accordance with claim 4 including a plurality of bores communicating with said passages and extending to said chill plate surface, one of said plugs being received in each of said bores, and each of said plugs extending beyond said bores into said passages whereby each plug member is directly contacted by said coolant.

6. A construction in accordance with claim 1 wherein said plug member is removably secured to said chill plate whereby the plug member is adapted to be separated from the chill plate with the casting and a new plug member is then associated with the chill plate for the next casting to be formed on the chill plate.

7. An apparatus in accordance with claim 1 wherein said plug member defines a portion flaring outwardly away from the surface of said chill plate.

8. An apparatus in accordance with claim 1 including a plurality of recesses in the chill plate surface adjacent said plug member.

9. An apparatus in acordance with claim 1 said plug member comprising pin means extending within said recess.

10. An apparatus in accordance with claim 1 including insulation positioned between the bottom surfaces of said mold and the opposed surfaces of said chill plate for inhibiting the withdrawal of heat from the mold into the chill plate.

11. An apparatus in accordance with claim 1 wherein said mold defines a bottom surface extending outwardly from an inner edge defining the bottom of the mold cavity to the outer rim of the mold, said bottom surface engaging the chill plate surface in the area immediately adjacent said inner edge, said chill plate surface being recessed beyond said area of engagement whereby an insulating gap is defined between the bottom surface of the mold and said chill plate.

12. In an apparatus for the production of directionally solidified castings including a ceramic mold having an open bottom supported on a chill plate, and means for pouring molten metal into the mold, the chill plate defining a surface for direct contact with the molten metal whereby the metal initially solidifies adjacent the chill plate with the casting thereafter solidifying progressively away from the chill plate, the portion of the metal contacting the chill plate and initially solidifying tending to shrink and to draw away from said chill plate surface thereby inhibiting heat transfer between the solidified metal and the chill plate, the improvement comprising a heat conductive plug member defining a threaded surface area incorporated in said chill plate for communication with said open bottom of said mold, said casting thereby solidifying around said surface area of the plug member whereby the casting is securely held in intimate contact with the plug member and is inhibited against drawing away from said chill plate surface upon shrinkage of the metal, heat transfer between the solidified metal and the chill plate being thereby enhanced and heat thereby being withdrawn through the plug member and the chill plate as the casting solidifies.

13. An apparatus in accordance with claim 12 wherein said plug member extends outwardly from the chill plate surface and is externally threaded.

14. An apparatus in accordance with claim 12 wherein said plug member extends inwardly from the chill plate surface and is internally threaded.

15. In an apparatus for the production of directionally solidified castings including a ceramic mold having an open bottom supported on a chill plate, and means for pouring molten metal into the mold, the chill plate defining a surface for direct contact with the molten metal whereby the metal initially solidifies adjacent the chill plate with the casting thereafter solidifying progressively away from the chill plate, the portion of the metal contacting the chill plate and initially solidifying tending to shrink and to draw away from said chill plate surface thereby inhibiting heat transfer between the solidified metal and the chill plate, the improvement comprising a heat conductive plug member having an undercut surface area incorporated in said chill plate for communication with said open bottom of said mold, said casting thereby solidifying around the plug member whereby the casting is securely held in intimate contact with the plug member and is inhibited against drawing away from said chill plate surface upon shrinkage of the metal, heat transfer between the solidified metal and the chill plate being thereby enhanced and heat thereby being withdrawn through the plug member and the chill plate as the casting solidifies, and including a passage extending from the chill plate surface downwardly through the chill plate, said plug member being inserted in said passage, and ejection means for insertion in said passage and for engagement with said plug member and the casting associated therewith for separating the plug member and casting from the chill plate.

* * * * *